US007106281B2

(12) United States Patent
Kim et al.

(10) Patent No.: US 7,106,281 B2
(45) Date of Patent: Sep. 12, 2006

(54) APPARATUS AND METHOD FOR DRIVING ELECTRO-LUMINESCENCE PANEL

(75) Inventors: Chang Yeon Kim, Seoul (KR); Han Sang Lee, Kunpo-shi (KR); Myoung Ho Lee, Uiwang-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 103 days.

(21) Appl. No.: 10/178,502

(22) Filed: Jun. 25, 2002

(65) Prior Publication Data

US 2003/0038760 A1 Feb. 27, 2003

(30) Foreign Application Priority Data

Aug. 25, 2001 (KR) ..... 2001-51569

(51) Int. Cl.
*G09G 3/30* (2006.01)

(52) U.S. Cl. ..... 345/76; 345/45; 345/84

(58) Field of Classification Search ..... 345/76, 345/78, 79, 39, 45, 55, 82, 84, 77
See application file for complete search history.

(56) References Cited

U.S. PATENT DOCUMENTS 6,084,579 A * 7/2000 Hirano ..... 345/205
6,229,506 B1 5/2001 Dawson et al.
6,229,508 B1 5/2001 Kane
6,369,786 B1 * 4/2002 Suzuki ..... 345/77
6,628,258 B1 * 9/2003 Nakamura ..... 345/98
6,731,266 B1 * 5/2004 Jung ..... 345/103
2005/0190177 A1 * 9/2005 Yumoto ..... 345/211

FOREIGN PATENT DOCUMENTS

KR 2001-077572 8/2001

* cited by examiner

*Primary Examiner*—Richard Hjerpe
*Assistant Examiner*—Jean Lesperance
(74) *Attorney, Agent, or Firm*—McKenna Long & Aldridge LLP

(57) ABSTRACT

An apparatus and method for driving an electro-luminescence panel wherein pixels in a current driving type electrode-luminescence panel are pre-charged to change a storage voltage of the pixel into the corresponding voltage within a limited scanning time. In the apparatus, a plurality of electro-luminescence cells are arranged at crossings between gate lines and data lines. A gate driver is connected to the gate lines to sequentially drive the gate lines. A data driver is connected to the data lines to apply pixel signals, via the data lines, to the electro-luminescence cells. A pre-charger is provided within the data driver to pre-charge a current into the data lines before the pixel signals are applied via the data lines.

20 Claims, 6 Drawing Sheets

APPARATUS AND METHOD FOR DRIVING ELECTRO-LUMINESCENCE PANEL

This application claims the benefit of Korean Patent Application No. 2001-51569, filed on Aug. 25, 2001, which is hereby incorporated by reference for all purposes as if fully set forth herein.

BACKGROUND OF THE INVENTION

1. Field of the Invention

This invention relates to an electro-luminescence display (ELD), and more particularly to an apparatus and method for driving an electro-luminescence panel wherein pixels existing in gate lines of a current driving type electro-luminescence panel are pre-charged to change a storage voltage of the pixel into the corresponding voltage within a limited scanning time.

2. Discussion of the Related Art

Recently, there have been developed various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) panel, etc.

Studies for heightening a display quality of the flat panel display device and for providing the flat panel display with a large-scale screen have been actively made. The EL panel in such display devices is a self-emission device capable of being emitted for itself. The EL panel excites a fluorescent material using carriers such as electrons and holes, etc. to display a video image. The EL panel has advantages in that a low direct current voltage driving is possible and a response speed is fast.

As shown in FIG. 1, such an EL panel includes gate lines GL1 to GLm and data lines DL1 to DLn arranged on a glass substrate 10 in such a manner to cross each other, and pixel elements PE arranged at intersections between the gate lines GL1 to GLm and the data lines DL1 to DLn. Each of the pixel elements PE is driven when gate signals on the gate lines GL1 to GLm are enabled, thereby generating a light corresponding to a magnitude of a pixel signal on the data line DL.

In order to drive such an EL panel, a gate driver 12 is connected to the gate lines GL1 to GLm, and a data driver 14 is connected to the data lines DL1 to DLn. The gate driver 12 sequentially drives the gate lines GL1 to GLm. The data driver 14 applies pixel signals, via the data lines DL1 to DLn, to the pixel elements PE.

As shown in FIG. 2, each of the pixel elements PE driven with the gate driver 12 and the data driver 14 consists of an EL cell OELD connected to a ground voltage line GND, and a cell driving circuit 16 for driving the EL cell OLED.

FIG. 2 is a detailed circuit diagram of the pixel element PE shown in FIG. 1, which includes a driving circuit arranged at an intersection between the gate line GL and the data line DL, that is, four TFT's T1, T2, T3 and T4.

Referring to FIG. 2, the pixel element PE includes an EL cell OLED connected to a ground voltage source GND, and an EL cell driving circuit 16 connected between the EL cell OLED and the data line DL.

The EL cell driving circuit 16 includes the first and second PMOS TFTs T1 and T2 connected to the EL cell OLED and the supply voltage line VDD, a third PMOS TFT T3 connected to the second PMOS TFT T2, the data line DL and the gate line GL to respond to a signal on the gate line GL, a fourth PMOS TFT T4 connected to the gate electrodes of the first and second PMOS TFT's T1 and T2, the gate line GL and the third PMOS TFT T3, and a capacitor Cst connected between the gate electrodes of the first and second PMOS TFTs T1 and T2 and the supply voltage line VDD.

In operation, when a low input signal is applied to the gate line GL as shown in FIG. 3, the third and fourth PMOS TFTs T3 and T4 are turned on. If so, a video signal with a certain amplitude inputted in synchronization with a scanning signal from the data line DL is charged into the capacitor Cst via the third and fourth PMOS TFTs T3 and T4. The capacitor Cst is connected to the gate electrodes of the first and second PMOS TFTs T1 and T2 and the supply voltage VDD to charge the video signal from the data line DL during a low voltage input period of the gate line GL.

The capacitor Cst holds the video signal applied from the data line DL and then charged during one frame interval. Because of this holding time, the capacitor Cst keeps an application of the video signal from the data line DL to the EL cell OLED. Further, such a structure must include the number of data lines DL receiving each picture signal in correspondence with an input of each video signal such as red(R), green(G) and blue(B) signals. After being held for one frame interval, the video signal charged in the capacitor Cst is applied to the EL cell OLED to display an image on the display panel.

However, the conventional EL panel driving apparatus has difficulty in charging and discharging the storage capacitor Cst by a driving current Id within a limited gate line scanning time to change the driving current Id into the corresponding voltage because a very small current is used as the driving current Id. Herein, the gate line scanning time means a time at which the third and fourth PMOS TFTs T3 and T4 have been simultaneously turned on.

SUMMARY OF THE INVENTION

Accordingly, it is an object of the present invention to provide an apparatus and method for driving an electro-luminescence panel wherein a pre-charging is made for each gate line between data charging/discharging times of the previous gate line and the current data line to charge and discharge a storage capacitor by a driving current within a limited gate line scanning time, thereby changing the driving current into the corresponding voltage.

In order to achieve these and other objects of the invention, a driving apparatus for an electro-luminescence panel according to one aspect of the present invention includes a plurality of gate lines; a plurality of data lines crossing the gate lines; a plurality of electro-luminescence cells arranged at intersections between the gate lines and the data lines; a gate driver connected to the gate lines to sequentially drive the gate lines; a data driver connected to the data lines to apply pixel signals, via the data lines, to the electro-luminescence cells; and a pre-charger provided within the data driver to pre-charge a current into the data lines before the pixel signals are applied via the data lines.

The driving apparatus further includes cell-driving means provided at each electro-luminescence cell to control a quantity of a light emitted from the electro-luminescence cell in response to a signal on the data line.

The cell driving means includes the first and second switching devices connected to the electro-luminescence cell and a supply voltage line in such a manner to form a current mirror to apply said pixel voltage signal to the electro-luminescence cell; a voltage charging device for charging said pixel signal from the data line to apply the charged pixel signal to said current mirror; the third switching device connected to the data line and the gate electrodes of the first and second switching devices to respond to a signal on the gate line; and the fourth switching device connected to the gate electrodes of the first and second switching devices, the third switching device and the voltage charging device to be selectively coupled to the voltage charging device in response to a signal from the switching driver.

In the driving apparatus, the pre-charger is floating means for floating the data lines.

The pre-charger is a pre-charging voltage source for applying a desired voltage to the data line to pre-charge a storage capacitor. Herein, the desired voltage is about 10V.

Alternatively, the pre-charger is a pre-charging current source for applying a desired current to the data line to pre-charge the storage capacitor by a certain voltage.

A method of driving an electro-luminescence panel according to another aspect of the present invention includes the steps of: applying a scanning signal with a pulse shape to gate lines; pre-charging a storage capacitor within electro-luminescence cell during a desired time by means of a pre-charger; and applying pixel signals, via a data driver, to data lines after said per-charging.

In the method, the step of pre-charging the storage capacitor includes floating the data line; allowing a current to be floated in the storage capacitor by a storage voltage held in the previous frame interval; and pre-charging the storage capacitor by a voltage resulting from a current applied to the storage capacitor.

Otherwise, the step of pre-charging the storage capacitor includes applying a desired voltage by means of the pre-charger; and pre-charging a desired voltage into the storage capacitor by a voltage difference between a supply voltage source for driving the electro-luminescence cell and a voltage source for said desired voltage. Herein, said desired voltage is about 10V.

Alternatively, the step of pre-charging the storage capacitor includes applying a desired current to the data line by means of the pre-charger; and pre-charging a desired voltage by a said desired current into the storage capacitor by a capacitance value of the storage capacitor.

BRIEF DESCRIPTION OF THE DRAWINGS

These and other advantages of the invention will be apparent from the following detailed description of the embodiments of the present invention with reference to the accompanying drawings, in which.

DETAILED DESCRIPTION OF THE ILLUSTRATED EMBODIMENTS

Figure 4:
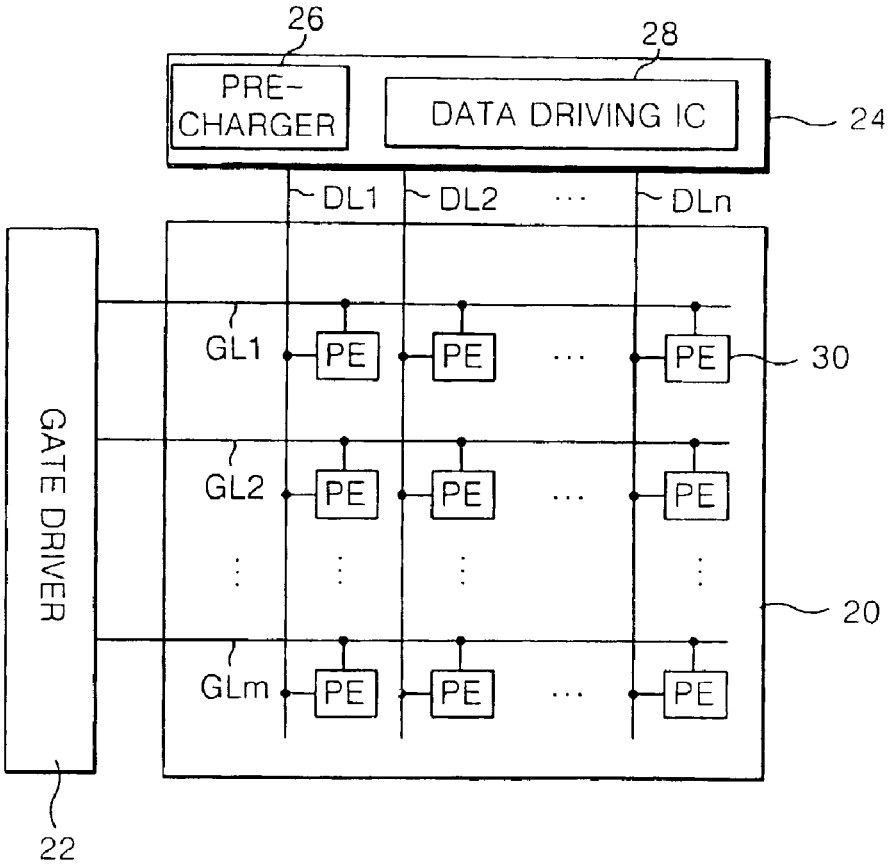
FIG. 4 is a schematic block diagram showing a configuration of an electro-luminescence panel according to an embodiment of the present invention.

FIG. 4 schematically illustrates a configuration of a current driving type EL panel according to an embodiment of the present invention.

Referring to FIG. 4, the EL panel driving apparatus includes an EL panel 20, a data driver 24 and a gate driver 22. The data driver includes a pre-charger 26 for pre-charging data inputted from the exterior, and a data driving integrated circuit (IC) 28 for normally applying pixel signals via data lines DL1 to DLn.

Figure 1:
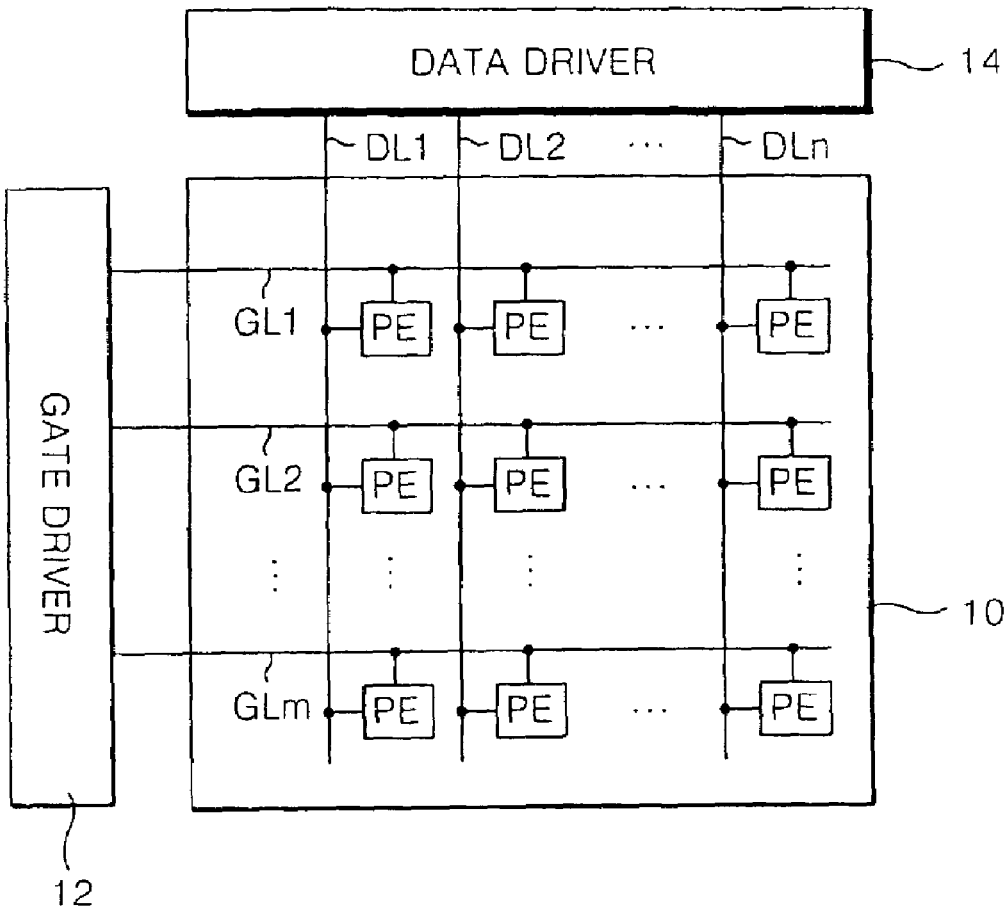
FIG. 1 CONVENTIONAL ART
FIG. 1 is a schematic block diagram showing a configuration of a conventional electro-luminescence panel.
Figure 2:
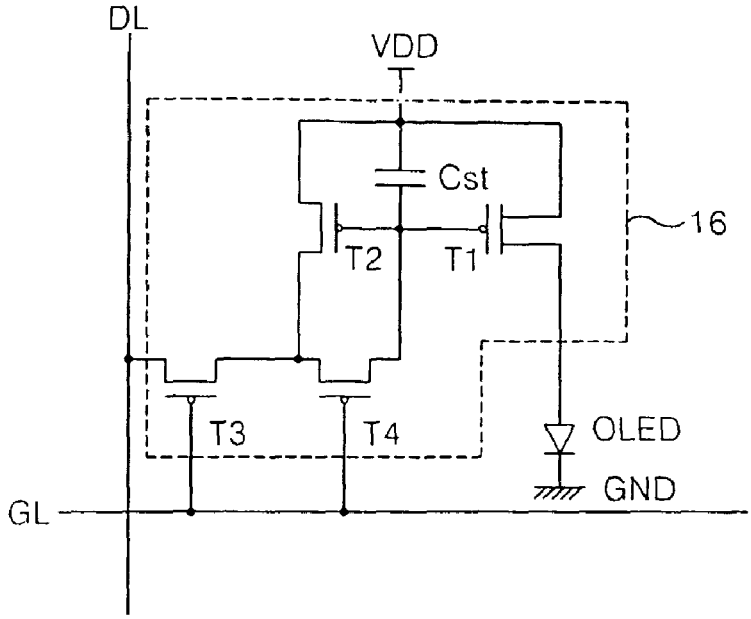
FIG.2 CONVENTIONAL ART
FIG. 2 is a detailed circuit diagram of the pixel element shown in FIG. 1.
Figure 3:
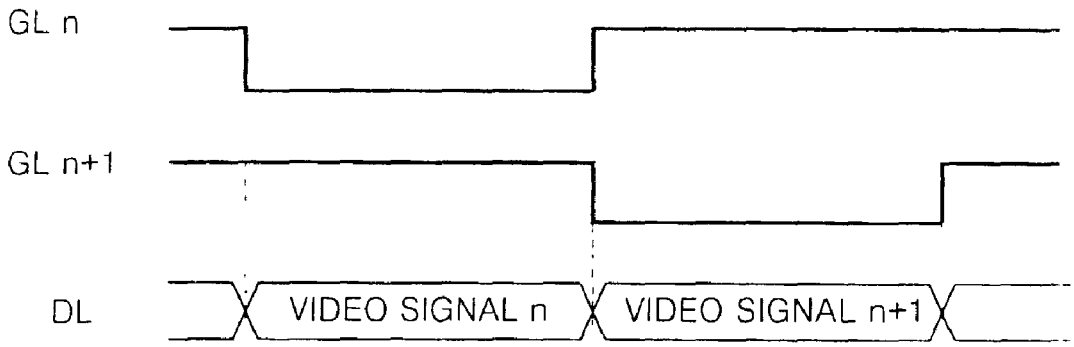
FIG.3 CONVENTIONAL ART
FIG. 3 is a timing diagram of a driving signal for driving the pixel element of FIG. 2.

Like the conventional EL panel as shown in FIG. 2, the present EL panel includes gate lines GL1 to GLm and data lines DL1 to DLn arranged on a glass substrate in such a manner to cross each other, and pixel elements (PE) 30 arranged at intersections between the gate lines GL1 to GLm and the data lines DL1 to DLn. Each of the pixel elements 30 is driven when gate signals on the gate lines GL1 to GLm are enabled, thereby generating light corresponding to a magnitude of a pixel signal on the data line DL.

In order to drive such an EL panel, a gate driver 22 is connected to the gate lines GL1 to GLm while a data driver 24 is connected to the data lines DL1 to DLn. The gate driver 22 sequentially drives the gate lines GL1 to GLm. The data driver 24 pre-charges each gate line by means of the pre-charger 26 and thereafter applies the pixel signals, via the data driving IC 28 and the data lines DL1 to DLn, to the pixel elements 30.

Figure 5:
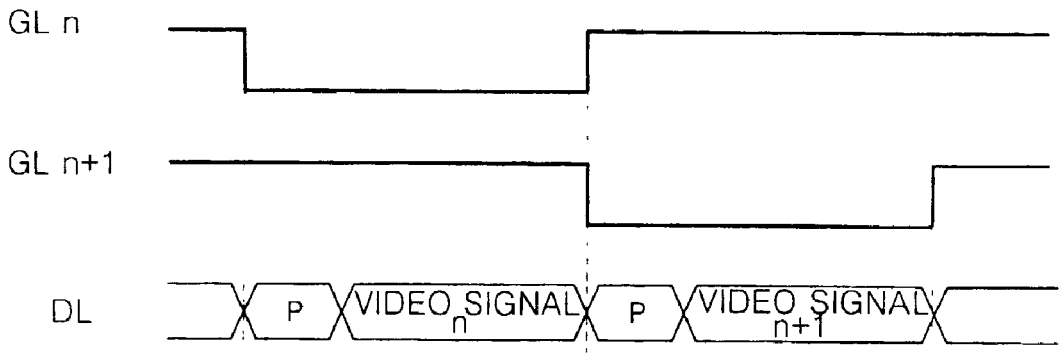
FIG. 5 is a timing diagram of a driving signal for driving the pixel element shown in FIG. 4.

FIG. 5 is a timing diagram of a driving signal for driving the pixel element by means of the data driver shown in FIG. 4.

Referring to FIG. 5, in the first interval, a low input signal is inputted to the nth gate line GLn while a high input signal is inputted to the (n+1)th gate line GLn+1. In this case, after data is pre-charged as indicated by P during a certain time by means of the data driver 24, the nth video signal applied to the data line DL is charged.

In the second interval, a high input signal is inputted to the nth gate line GLn while a low input signal is inputted to the (n+1)th gate line GLn+1. Likewise, after a data is pre-charged as indicated by P during a certain time by means of the data driver 24, the (n+1)th video signal applied to the data line DL is charged.

Such a pre-charging for each gate line can solve a failure of a charge/discharge generated near a black level in the prior art.

This pre-charging method can be classified into three schemes as mentioned below.

Figure 6A:
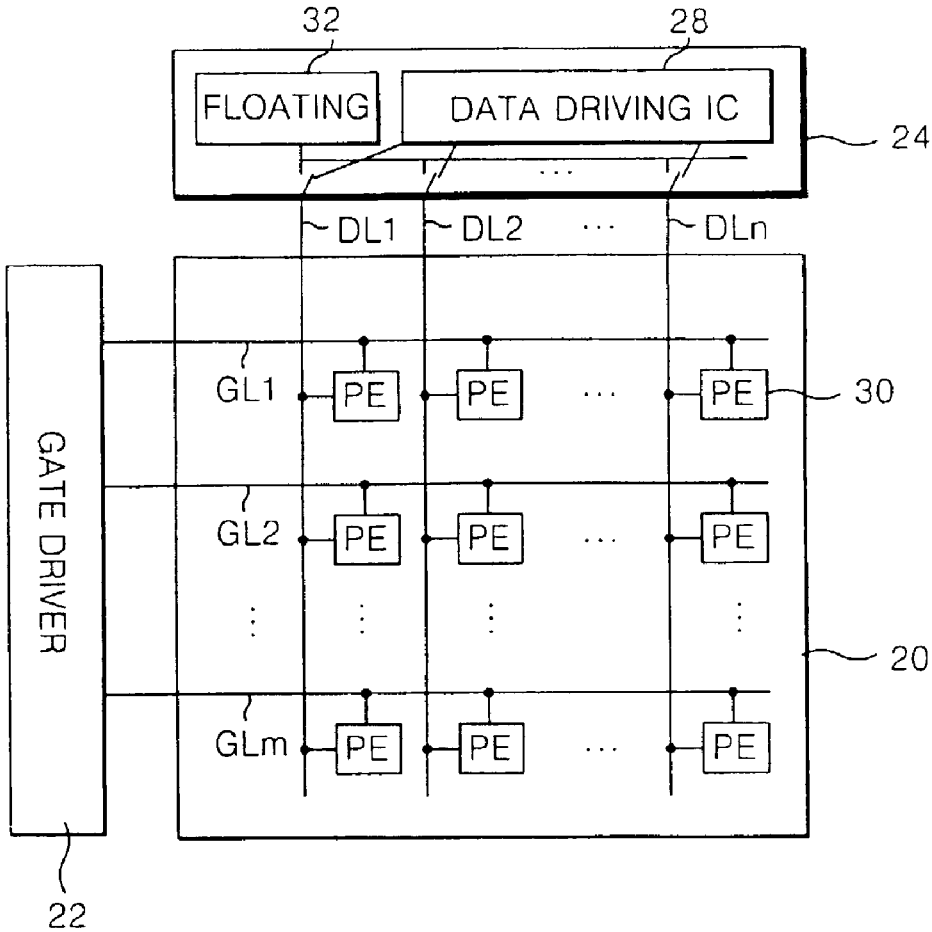
FIG. 6A is a schematic block diagram showing a configuration of an electro-luminescence panel according to a first embodiment of the present invention.
Figure 6B:
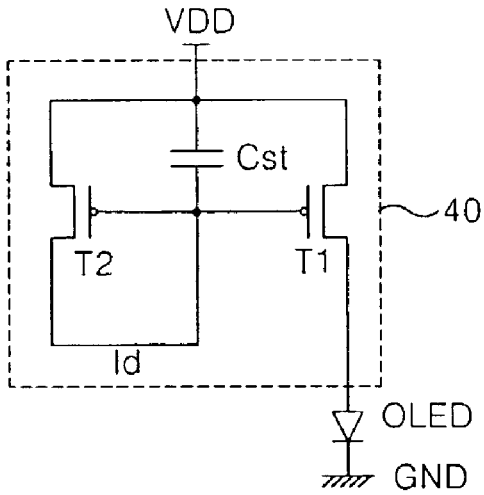
FIG. 6B is a detailed circuit diagram of the pixel element upon pre-charging in FIG. 6A.

First, FIG. 6A schematically illustrates a method of pre-charging an EL panel according to a first embodiment of the present invention, and FIG. 6B illustrates a driving circuits for a pixel element in the EL panel shown in FIG. 6A.

Referring to FIG. 6A, the driving apparatus for the EL panel includes an EL panel 20, a data driver 24 and a gate driver 22. The data driver 24 includes a floating pre-charger 32 for floating the data lines DL1 to DLn for pre-charging, and a data driving IC 28 for normally applying pixel signals via the data lines DL1 to DLn.

The EL panel 20 includes gate lines GL1 to GLm and data lines DL1 to DLn arranged on a glass substrate in such a manner to cross each other, and pixel elements (PE) 30 arranged at crossings between the gate lines GL1 to GLm and the data lines DL1 to DLn. Each of the pixel elements 30 is driven when gate signals on the gate lines GL1 to GLm are enabled, thereby generating light corresponding to a magnitude of a pixel signal on the data line DL.

In order to drive such an EL panel, the gate driver 22 is connected to the gate lines GL1 to GLm while the data driver 24 is connected to the data lines DL1 to DLn. The gate driver 22 sequentially drives the gate lines GL1 to GLm. The data driver 24 pre-charges each gate line by means of the floating pre-charger 32 and thereafter applies the pixel signals, via the data driving IC 28 and the data lines DL1 to DLn, to the pixel elements 30.

FIG. 6B illustrates an equivalent circuit of the pixel element 30 upon driving employing the floating pre-charger 32. The equivalent circuit includes an EL cell OLED connected to a ground voltage source GND and an EL cell driving circuit 40 connected between the EL cell OLED and the data line DL.

The EL cell driving circuit 40 includes the first and second PMOS TFTs T1 and T2 connected to the EL cell OLED and a supply voltage line VDD in such a manner to form a current mirror, and a capacitor Cst connected between the gate electrodes of the first and second PMOS TFTs T1 and T2 and the supply voltage line VDD. The data lines DL1 to DLn are floated to result in the circuit of FIG. 6B.

In operation, after a low signal was applied to the gate lines GL1 to GLn of the EL panel 20 to turn on the first and second PMOS TFTs T1 and T2, the data lines DL1 to DLn are floated. In this case, a driving current Id flows into the storage capacitor Cst owing to a voltage held in the storage capacitor Cst during the previous frame to thereby pre-charge a voltage Vst of the storage capacitor Cst by a low voltage. Thereafter, a video signal applied from the data driving IC 28 of the data driver 24 to the data line DL is charged.

Figure 7A:
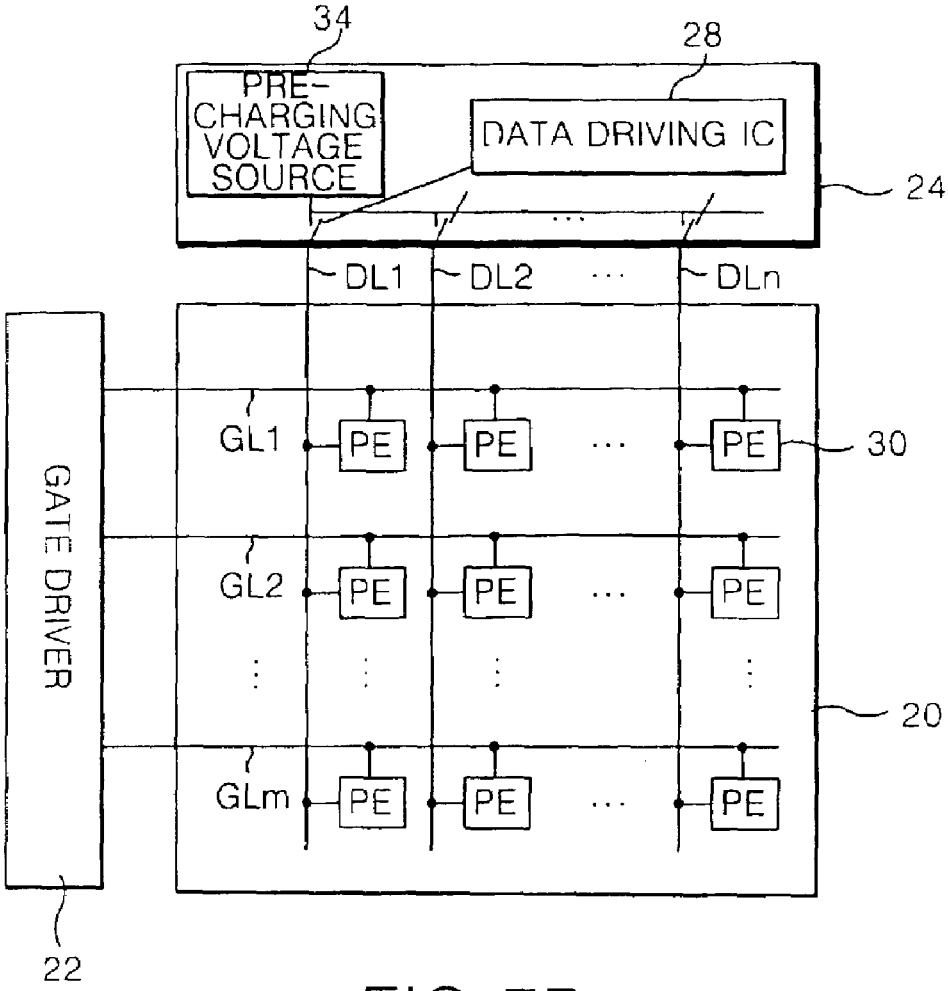
FIG. 7A is a schematic block diagram showing a configuration of an electro-luminescence panel according to a second embodiment of the present invention.
Figure 7B:
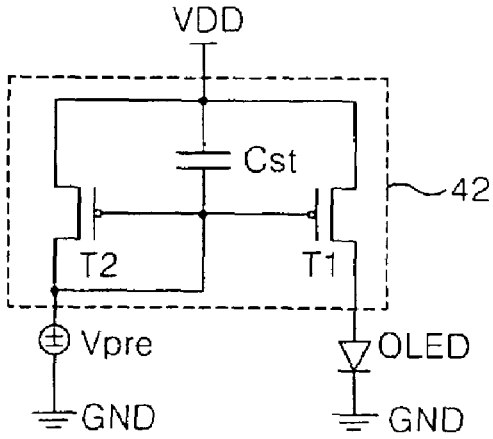
FIG. 7B is a detailed circuit diagram of the pixel element upon pre-charging in FIG. 7A.

FIG. 7A schematically illustrates pre-charging an EL panel according to a second embodiment of the present invention, and FIG. 7B illustrates a driving circuit for a pixel element in the EL panel shown in FIG. 7A.

Referring to FIG. 7A, the driving apparatus for the EL panel includes an EL panel 20, a data driver 24 and a gate driver 22. The data driver 24 includes a pre-charging voltage source 34 for applying a certain voltage to pre-charge the data lines DL1 to DLn, and a data driving IC 28 for normally applying pixel signals via the data lines DL1 to DLn.

The EL panel 20 includes gate lines GL1 to GLm and data lines DL1 to DLn arranged on a glass substrate in such a manner to cross each other, and pixel elements (PE) 30 arranged at crossings between the gate lines GL1 to GLm and the data lines DL1 to DLn. Each of the pixel elements 30 is driven when gate signals on the gate lines GL1 to GLm are enabled, thereby generating light corresponding to a magnitude of a pixel signal on the data line DL.

In order to drive such an EL panel, the gate driver 22 is connected to the gate lines GL1 to GLm while the data driver 24 is connected to the data lines DL1 to DLn. The gate driver 22 sequentially drives the gate lines GL1 to GLm. The data driver 24 pre-charges each gate line by means of the pre-charging voltage source 34 and thereafter applies pixel signals, via the data driving IC 28 and the data lines DL1 to DLn, to the pixel elements 30.

FIG. 7B illustrates an equivalent circuit of the pixel element 30 upon driving employing the pre-charging voltage source 34. The equivalent circuit includes an EL cell OLED connected to a ground voltage source GND and an EL cell driving circuit 42 connected between the EL cell OLED and the data line DL.

The EL cell driving circuit 42 includes first and second PMOS TFTs T1 and T2 connected to the EL cell OLED and a supply voltage line VDD in such a manner to form a current mirror, and a capacitor Cst connected between the gate electrodes of the first and second PMOS TFTs T1 and T2 and the supply voltage line VDD. Further, the pre-charging voltage source 34 in FIG. 7A is connected to nodes between the gate electrodes of the first and second PMOS TFTs T1 and T2 and the source electrode of the first PMOS TFT T1.

In operation, if a voltage is applied to the data line DL by means of a certain voltage source after a low signal was applied to the gate lines GL1 to GLn of the EL panel 20 to turn on the first and second PMOS TFT's T1 and T2, then a pre-charging voltage Vpre is charged in the storage capacitor Cst, and the EL cell is pre-charged by a voltage (VDD–Vpre) obtained by subtracting a voltage from the pre-charging voltage source 34 from a voltage from the supply voltage source VDD. Thereafter, a video signal applied from the data driving IC 28 of the data driver 24 to the data line DL is charged. In this case, a pre-charging voltage value can be either fixed or varied.

Figure 8A:
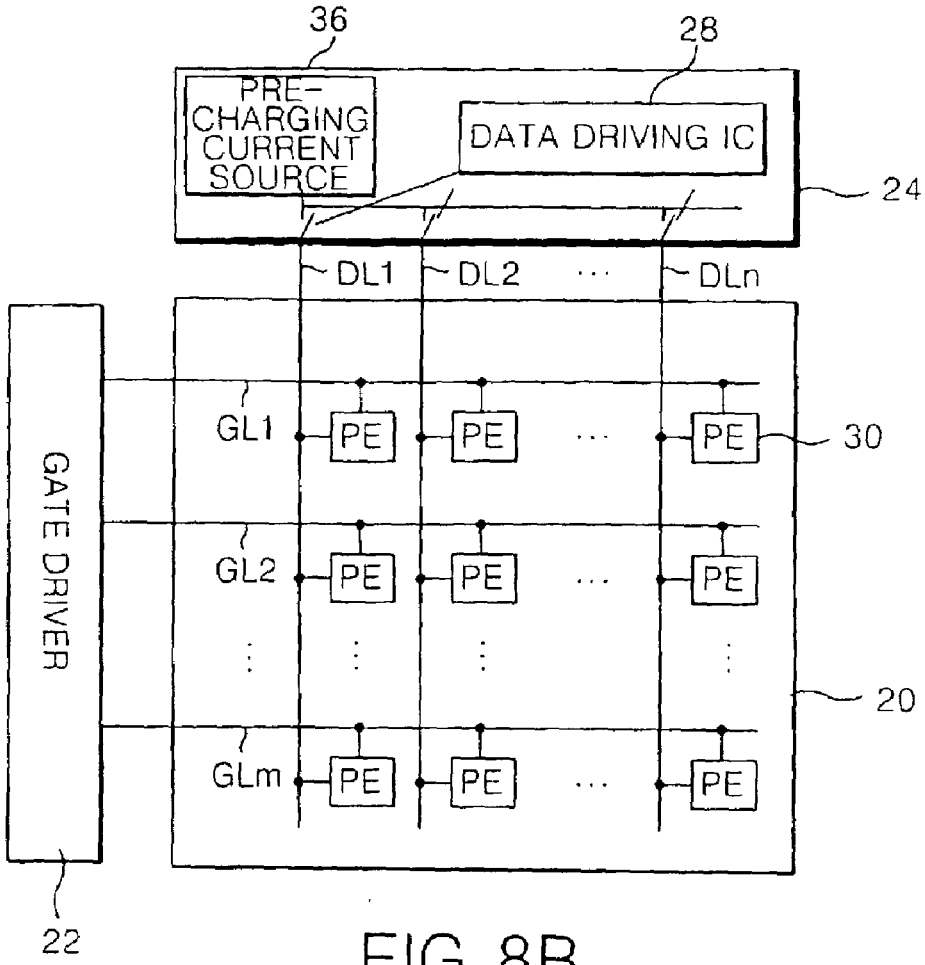
FIG. 8A is a schematic block diagram showing a configuration of an electro-luminescence panel according to a third embodiment of the present invention.
Figure 8B:
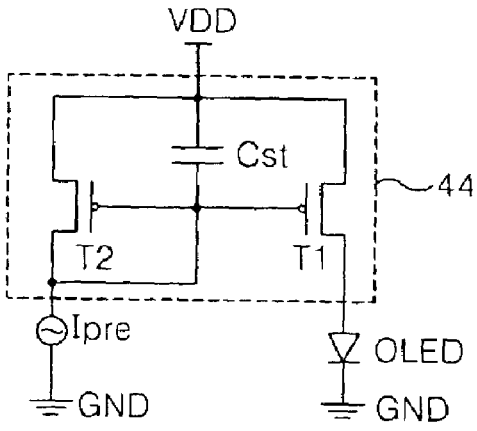
FIG. 8B is a detailed circuit diagram of the pixel element upon pre-charging in FIG. 8A.

FIG. 8A schematically illustrates pre-charging an EL panel according to a third embodiment of the present invention, and FIG. 8B illustrates a driving circuits for a pixel element in the EL panel shown in FIG. 8A.

Referring to FIG. 8A, the driving apparatus for the EL panel includes an EL panel 20, a data driver 24 and a gate driver 22. The data driver 24 includes a pre-charging current source 36 for applying a certain current to pre-charge the data lines DL1 to DLn and a data driving IC 28 for normally applying pixel signals via the data lines DL1 to DLn.

The EL panel 20 includes gate lines GL1 to GLm and data lines DL1 to DLn arranged on a glass substrate in such a manner to cross each other, and pixel elements (PE) 30 arranged at intersections between the gate lines GL1 to GLm and the data lines DL1 to DLn. Each of the pixel elements 30 is driven when gate signals on the gate lines GL1 to GLm are enabled, thereby generating light corresponding to a magnitude of a pixel signal on the data line DL.

In order to drive such an EL panel, the gate driver 22 is connected to the gate lines GL1 to GLm while the data driver 24 is connected to the data lines DL1 to DLn. The gate driver 22 sequentially drives the gate lines GL1 to GLm. The data driver 24 pre-charges each gate line by means of the pre-charging current source 36 and thereafter applies pixel signals, via the data driving IC 28 and the data lines DL1 to DLn, to the pixel elements 30.

FIG. 8B illustrates an equivalent circuit of the pixel element 30 upon driving employing the pre-charging current source 36. The equivalent circuit includes an EL cell OLED connected to a ground voltage source GND and an EL cell driving circuit 44 connected between the EL cell OLED and the data line DL.

The EL cell driving circuit 44 includes first and second PMOS TFTs T1 and T2 connected to the EL cell OLED and a supply voltage line VDD in such a manner to form a current mirror, and a capacitor Cst connected between the gate electrodes of the first and second PMOS TFTs T1 and T2 and the supply voltage line VDD. Further, the pre-charging current source 36 in FIG. 8A is connected to nodes between the gate electrodes of the first and second PMOS TFTs T1 and T2 and the source electrode of the first PMOS TFT T1.

In operation, if a current is applied to data lines DL1 to DLn by means of the pre-charging current source 36 after a low input signal is applied to the gate lines GL1 to GLn of the EL panel 20 to turn on the first and second PMOS TFTs T1 and T2, then this current and the storage capacitor Cst stored at the previous frame can pre-charge a certain voltage into the data lines DL1 to DLn. Thereafter, normal video signals from the data driving IC 28 of the data driver 24 are sent to the data lines DL1 to DLn, and they are charged in the EL cell. In this case, a pre-charging current value can be either fixed or varied.

As described above, according to the present invention, a separate floating driver, pre-charging voltage source or pre-charging current source is included in the data driver to apply a pre-charging signal to a single data line before a video signal is charged, thereby charging/discharging the storage capacitor within a limited gate line scanning time with the aid of a driving current resulting from this pre-charging signal to change the driving current into the corresponding voltage.

It should be appreciated that, while the exemplary embodiments discussed above employ PMOS transistors, NMOS transistor or any other appropriate switching element, can be used provided the driving signals are appropriately provided, including having the appropriate polarity.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for an electro-luminescence panel comprising:

a plurality of gate lines;

a plurality of data lines crossing the gate lines to define a plurality of pixel elements, wherein each of the pixel elements includes at least one switching transistor, one driving transistor, a storage capacitor connected between a gate electrode of the driving transistor and a voltage source, and an organic light emitting diode connected to a drain electrode of the driving transistor;

a gate driver connected to the gate lines to sequentially drive the gate lines;

a data driver connected to the data lines to apply pixel signals, via the data lines, to the pixel elements; and a pre-charger provided within the data driver to pre-charge the storage capacitors before the pixel signals are applied via the data lines.

2. The driving apparatus according to claim 1, wherein the driving transistor includes first and second switching devices and the switching transistor includes the third and fourth switching devices.

3. The driving apparatus according to claim 2, wherein the first and second switching devices are connected to the organic light emitting diode and the voltage source in such a manner to form a current mirror to apply said pixel signals to the organic light emitting diode;

the third switching device is connected to the data line and the first and second switching devices to respond to a signal on the gate line; and the fourth switching device is connected to the first and second switching devices, the third switching device and the storage capacitor to selectively couple at least one of the first, second, and third switching devices to the storage capacitor in response to a signal from the gate driver.

4. The driving apparatus of claim 3, wherein at least the first and second switching devices are PMOS thin film transistors.

5. The driving apparatus of claim 3, wherein at least one of the third and fourth switching devices is a PMOS thin film transistor.

6. The driving apparatus of claim 3, wherein at least the first and second switching devices are NMOS thin film transistors.

7. The driving apparatus of claim 3, wherein at least one of the third and fourth switching devices is an NMOS thin film transistor.

8. The driving apparatus of claim 3, wherein the third switching device is connected to gate electrodes of the first and second switching devices.

9. The driving apparatus of claim 8, wherein the fourth switching device is connected to gate electrodes of the first and second switching devices.

10. The driving apparatus of claim 3, wherein the fourth switching device is connected to gate electrodes of the first and second switching devices.

11. The driving apparatus according to claim 1, wherein said pre-charger is a floating means for floating a voltage on the data lines.

12. The driving apparatus according to claim 1, wherein said pre-charger is a pre-charging voltage source for applying a desired voltage to the data line to pre-charge the storage capacitor.

13. The driving apparatus according to claim 1, wherein said pre-charger is a pre-charging current source for applying a desired current to the data line to pre-charge the storage capacitor by a certain voltage.

14. A method of driving an electro-luminescence panel including a plurality of gate lines, a plurality of data lines crossing the gate lines, a plurality of pixel elements arranged at crossings between the gate lines and the data lines, a pre-charger for applying pre-charging signals to the pixel elements, wherein each of the pixel elements includes at least one switching transistor, one driving transistor, a storage capacitor connected between a gate electrode of the driving transistor and a voltage source, and an organic light emitting diode connected to a drain electrode of the driving transistor, said method comprising:

applying a scanning signal with a pulse shape to one of the gate lines;

pre-charging the storage capacitors within the pixel elements connected to said gate line during a desired time by means of said pre-charger; and applying pixel signals, via a data driver, to the data lines after said pre-charging.

15. The method according to claim 14, wherein said step of pre-charging the storage capacitor includes:

floating the data line;

allowing a current to be floated in the storage capacitor by a storage voltage held from a previous frame interval; and pre-charging the storage capacitor by a voltage resulting from the current applied to the storage capacitor.

16. The method according to claim 14, wherein said step of pre-charging the storage capacitor includes:

applying a desired voltage by means of the pre-charger; and pre-charging a desired voltage into the storage capacitor by a voltage difference between a supply voltage source for driving the organic light emitting diode and a voltage source for said desired voltage.

17. The method according to claim 14, wherein said step of pre-charging a storage capacitor includes:

applying a desired current to the data line by means of the pre-charger; and pre-charging a desired voltage by a said desired current into the storage capacitor by a capacitance value of the storage capacitor.

18. An electro-luminescence panel comprising:

a plurality of gate lines;

a plurality of data lines crossing the gate lines;

a plurality of pixel elements near crossings of the gate lines and the data lines, wherein each of the pixel elements includes at least one switching transistor, one driving transistor, a storage capacitor connected between a gate electrode of the driving transistor and a supply voltage line (VDD), and an organic light emitting diode connected between a drain electrode of the driving transistor and a ground voltage source (GND);

a gate driver connected to the gate lines for sequentially driving the gate lines;

a data driver connected to the data lines for applying pixel signals, via the data lines, to the pixel elements; and a pre-charger provided within the data driver for pre-charging a current into the storage capacitor via one of the data lines before one of the pixel signals is applied to one of the pixel element.

19. A driving apparatus for an electro-luminescence panel comprising:

a plurality of gate lines;

a plurality of data lines crossing the gate lines;

a plurality of pixel elements near crossings of the gate lines and the data lines, wherein each of the pixel elements includes at least one switching transistor, one driving transistor, a storage capacitor connected between a gate electrode of the driving transistor and a supply voltage line (VDD), and an organic light emitting diode connected to a drain electrode of the driving transistor;

a gate driver connected to the gate lines for sequentially driving the gate lines;

a data driver connected to the data lines for applying pixel signals, via the data lines, to the pixel elements; and a pre-charger provided within the data driver for pre-charging a current into the storage capacitor via the data lines before the pixel signals are applied to the pixel elements, wherein the storage capacitor maintains one of the pixel signals for one frame interval.

20. A method of driving an electro-luminescence panel including a plurality of gate lines, a plurality of data lines crossing the gate lines, a plurality of pixel elements near crossings of the gate lines and the data lines, a pre-charger for applying a pre-charging signal to the data lines, wherein each of the pixel elements includes at least one switching transistor, one driving transistor, a storage capacitor connected between a gate electrode of the driving transistor and a voltage source, and an organic light emitting diode connected to a drain electrode of the driving transistor said method comprising:

applying a scanning signal with a pulse shape to one of the gate lines;

pre-charging the storage capacitors within the pixel elements connected to said gate line during a desired time by means of said pre-charger; and applying pixel signals, via a data driver, to the data lines after said pre-charging, the storage capacitors maintaining the pixel signals for one frame interval.

* * * * *